US005118568A

United States Patent [19]

Okamoto et al.

[11] Patent Number: 5,118,568

[45] Date of Patent: Jun. 2, 1992

[54] STEEL CORD FOR REINFORCING RUBBER

[75] Inventors: Kenichi Okamoto; Hidekazu Nakata, both of Itami; Kazuhiko Kawamura, Toyota, all of Japan

[73] Assignees: Sumitomo Electric Industries, Ltd., Osaka; Sumitomo Rubber Industries, Ltd., Kobe, both of Japan

[21] Appl. No.: 504,475

[22] Filed: Apr. 4, 1990

[30] Foreign Application Priority Data

Apr. 8, 1989 [JP] Japan ..... 1-89089

[51] Int. Cl.[5] ..... B32B 15/02; B32B 5/16; D02G 3/26; D01H 13/26

[52] U.S. Cl. ..... 428/364; 428/377; 428/378; 428/379; 428/381; 428/389; 428/390; 428/401; 428/902; 428/371; 428/382; 57/200; 57/258; 57/314

[58] Field of Search ..... 57/200, 258, 314, 902; 428/902, 377, 378, 379, 380, 382, 389, 390, 401, 402, 364

[56] References Cited

U.S. PATENT DOCUMENTS 4,966,216 10/1990 Kawasaki et al. ..... 57/902

*Primary Examiner*—George F. Lesmes
*Assistant Examiner*—Kathryne E. Shelborne
*Attorney, Agent, or Firm*—Nikaido, Marmelstein, Murray & Oram

[57] ABSTRACT

A steel cord for reinforcing rubber. It is made of three steel filaments all having different diameters from one another. The small-diameter and medium-diameter ones of the three filaments have internal stresses adapted to be released when the cord is cut at both ends thereof. Owing to these stresses, the diameter of the cord is adapted to increase after it is cut at both ends. At the same time, the medium-diameter and small-diameter filaments retract inwardly from the ends of the large-diameter and medium-diameter ones, respectively.

3 Claims, 1 Drawing Sheet

STEEL CORD FOR REINFORCING RUBBER

Figure 1:
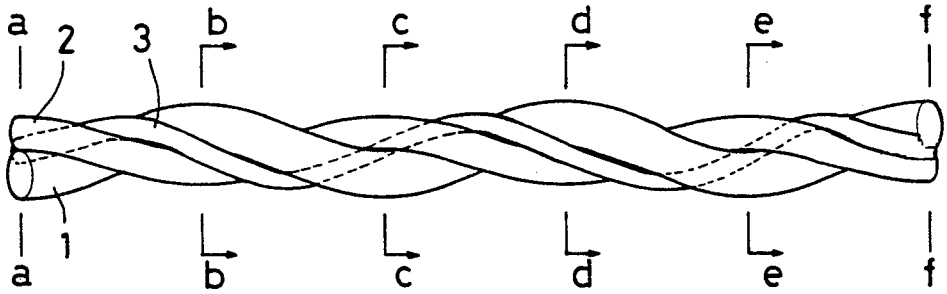

This invention relates to a steel cord which is effective in reinforcing a reinforcing fiber in a rubber structure such as an automotive tire and a conveyor belt, particularly a belt in a radial tire.

A steel radial tire for use with a vehicle has a belt layer made of two to four unidirectionally reinforced composite materials composed of steel cords and reinforcing rubber to increase the rigidity of its tread portion and thus to improve the ground gripping performance, wear resistance and fuel efficiency.

But such steel cords used in the belt layer have a specific gravity of 7.82–7.86, which is extremely large compared with that of the reinforcing rubber. Thus when the tire is rotating at a high speed, owing to a considerably large centrifugal force, the resistance to belt edge separation, which tends to start from the cord cut ends of the belt layer, drops or separation between belt layers tends to occur.

In order to prevent this, it was proposed to modify the quality of the rubber in the belt portion to restrain the separation in the belt end portion (Japanese Unexamined Patent Publication 56-43008). Especially with a tire intended to be used at high speed, its belt portion is further reinforced with steel cords or organic fiber cords to increase the resistance to a large centrifugal force during high speed rotation.

With a steel radial tire, an increase in the strain at the belt ends is a major cause of the edge separation starting from the cord cut ends of the belt layer. As one solution to this problem, it was contemplated to change the quality of the embeded rubber (in Japanese Unexamined Patent Publication 56-43008, the 100% modulus is set to 30–70 kg f/cm$^2$). But although filaments forming the steel cords are brass-plated to increase the adhesion to the rubber, the cords are not brass-plated at their ends and the adhesion to rubber is zero. Thus it is difficult to cope with the above problem simply by modifying the quality of rubber.

Thus it is essential to additionally reinforce with steel cords or organic fiber cords. As a natural result, the quality of steel cords used increase. This will in turn lead to increase in the weight of the entire tire, cost per tire and the fuel consumption.

It is an object of the present invention to provide a steel cord for reinforcing rubber which has such a structure as to prevent the belt edge separation and the separation between belt layers in order to improve the performance of a rubber composite material such as a steel radial tire without the need of any additional reinforcement.

It is another object of the present invention to provide a rubber composite structure in which the aforementioned steel cord is used.

With the steel cord according to the present invention, the stress in the small-diameter filament 3 and medium-diameter filament 2 is not released during the period from the twisting step till the calendering step where the cord is wound on a reel. Thus as is apparent from FIGS. 1 and 2, there are not so many circumferential irregularities on its cross-sectional plane.

Figure 3:
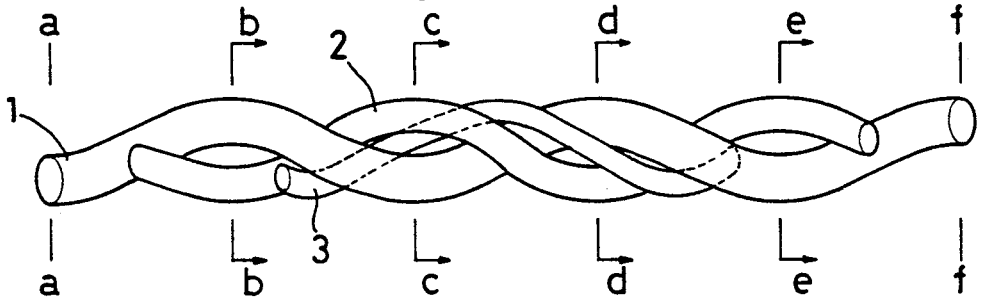
Figures 4A, 4B, 4C, 4D, 4E, 4F:
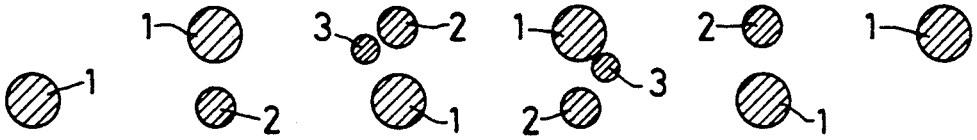

On the other hand, when the cord is combined with rubber into a composite structure (when it is unwound from the reel and cut at both ends thereof), the stress in the small-diameter and medium-diameter filaments will be released, thus causing an increase in the diameter of the cord as shown in FIGS. 3 and 4. This will increase the size of the gaps between the adjacent filaments, thus improving the rubber penetration. Further since the cord is longitudinally irregular to the touch to a suitable degree, its adhesion to rubber is enhanced. Also, the ends of the medium-diameter and small-diameter filaments will be retracted from the ends of the large-diameter and medium-diameter ones, respectively. Thus the ends of the cord are made less uniform. This will effectively prevent edge separation starting from the cut ends of the cord.

According to the present invention, when the cord is combined with rubber, it is prevented from turning into a closed cord so that good rubber penetration into the cord is ensured. Also peeling of plating on the pass line in the twisting or calendering step is prevented effectively. This will remarkably increase its adhesion and improve its corrosion resistance.

Also since the cord ends are composed of only the large-diameter filaments after cutting, the ends are made uneven. Thus the belt edge separation starting from the cord ends can be prevented effectively.

Also because of the $1\times3$ twisting structure, the filaments can be twisted into a cord easily. This improves the workability markedly, increase the productivity and reduce the cost. The composite structure using the steel cord of the present invention shows increased stability and reliability of reinforcement owing to the above-described effects. Also, if it is a tire, it is not necessary to change the width of the layer at the time of manufacture or to use any special rubber. This facilitates manufacture and reduces cost.

Figures 2A, 2B, 2C, 2D, 2E, 2F:
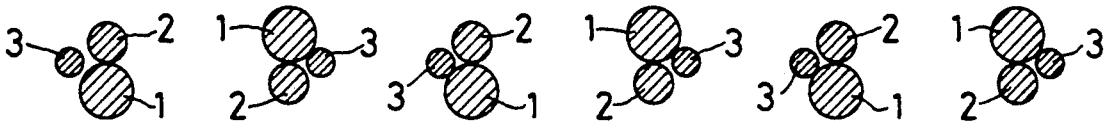
Figure 5A:
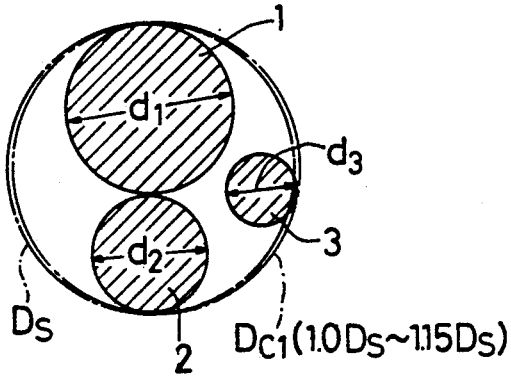
Figure 5B:
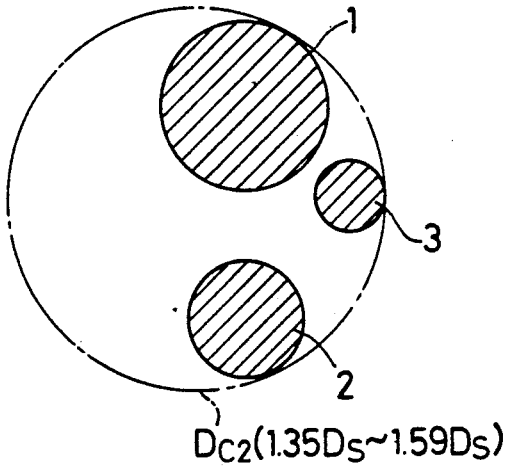

Other features and objects of the present invention will become apparent from the following description taken with reference to the accompanying drawings, in which:

FIG. 1 is a side view of the cord embodying the present invention in its non-cut state;

FIGS. 2*a*–2*f* are cross-sectional views of the same at the portions corresponding to the portions represented by identical characters in FIG. 1;

FIG. 3 is a side view of the cord of FIG. 1 in its state after being cut at both ends;

FIGS. 4*a*–4*f* are cross-sectional views of the same at the portions corresponding to the portions represented by identical characters in FIG. 3; and FIGS. 5*a* and 5*b* are comparative views showing how the diameter of the cord changes before and after cutting.

In order to keep the number of irregularities on the outer periphery to a minimum until the end of the calendering step and to increase it after the cord has been cut at both ends thereof, it is necessary to let some of the steel filaments in the steel cord possess an internal stress so that it will be released when both ends thereof are freed, thus allowing some of the filaments to spread outwardly of the cord while turning in an untwisting direction and shrinking longitudinally.

The present inventors have made effort to find a method therefor and found that the above object can be attained by making some of the filaments finer than the other filaments to be twisted together and twisting them together after giving a large degree of shaping to the finer filaments.

The steel filaments used should preferably have diameters within the range of 0.10–0.40 mm. Its upper limit is determined in view of reduction in fatigue properties and its lower limit is determined in view of an increase in cost. Within this range, the large-diameter filament 1 should have a diameter d1 of 0.32–0.40 mm, the medium-diameter filament 2 should have a diameter d2 of 0.22–0.29 mm and the small-diameter filament 3 should have a diameter d3 of 0.12–0.20 mm.

The inventors changed the diameter ratios among the steel filaments 1, 2 and 3 to find the ranges within which the ends of the small-diameter and medium-diamter filaments are retracted from the ends of the large-diameter filament by suitable lengths while forming suitable degree of irregularties on the outer periphery of the cord. As a result, they have reached a conclusion that the small-diameter filament 3 should have a diameter 0.31–0.50 time that of the large-diameter filament 1 and the medium-diameter filament 2 should have a diameter 0.55–0.73 time that of the large-diameter filament 1. If the lower limit of the former range is less than 0.31, the provision of the small-diameter filament 3 will become meaningless. Such a cord is virtually the same in function as a strand comprising two steel filaments. The upper limit of the former range and the lower time limit of the latter range are deemed to be appropriate in view of the ranges of the diamters of the other steel filaments used.

Also, if the upper limit of the latter range is larger than 0.73, the internal stress possessed by the medium-diameter filament 2 when cutting the cord ends will be too small for the filament 2 to spread outwardly to such an extent that good rubber penetration is assured and to be retracted from the ends of the large-diameter filament much enough to prevent edge separation.

In twisting the steel filaments having different diameters from one another, it is necessary to shape the small-diameter and medium-diameter filaments beforehand so that both of them will have a length of twist equal to that of the large-diameter filament or the small-diameter filament have a length of twist slightly larger than that of the large-diameter filament. Otherwise, when the cord is subjected to a tensile force, the small-diameter filament might be broken under the tension concentrated on it.

Therefore it is necessary to shape the small-diameter and medium-diameter filaments before twisting. But if they are shaped excessively, the circumferential as well as longitudinal hand-felt irregularities formed on the outer periphery of the cord will be so large that the small-diameter filament might be damaged on its surface in the twisting or calendering step. This will cause a reduction in the adhesion to rubber owing to the peeling of plating. To avoid this, it is necessary to restrict the shaping of the small-diameter filament and the medium-diameter filament, i.e. the size of irregularities on the steel cord by controlling the diameter of the cord.

The inventors conducted a tensile test of steel cords and observed the damage on the steel filaments twisted together. As a result, it was found that the most desirable range of the diameter of the steel cord while it is fixed at both ends (which corresponds to the state from the twisting step till the calendering step) is 1–1.5 times the diameter Ds of the circumscribed circle of the strand comprising the large-diameter filament 1 and the medium-diameter one 2.

The diameter of the cord when both ends of the steel cord are freed (which corresponds to the state after bias-cutting) is such that the small-diameter and the medium-diameter filaments expand outwardly owing to the release of stress kept therein to such an extent that the gaps formed between them and the large-diameter filaments will grow large enough to allow sufficient rubber penetration. But if the gaps between the filaments grow excessively, separation tends to occur especially between the large-diameter filament and the small-diameter filament during vulcanization under pressure at the time of the forming of a tire. As a result, the cord will lose its function as a $1\times3$ cord. Therefore, it is necessary to restrict the size of the gaps, too. Through these experiments, it was found out that after cutting the cord at both ends, its diameter should preferably be 1.35–1.59 times as large as the diameter Ds.

EXAMPLES

Brass-plated steel filaments for steel cords as shown in Tables 1, 2 and 3 were prepared. The steel filaments shown in Table 1, 2 and 3 were used as the small-diameter filaments 3, the medium-diameter filaments 2 and the large-diameter filaments 1, respectivlely.

The steel filaments in these Tables were combined to form steel cords according to the present invention (Examples 1–3) and, comparative cords (Comparative Examples 1–9). They were twisted so as to have a twisting pitch of 14 mm.

These cords were cut to a length L of 500 mm. After cutting the cords, the length of scattering of the small-diameter filament, the lengths by which the small-diameter and medium-diameter filaments retracted from the ends of the cords, and the rubber penetration were measured. The results are shown in Table 4. As is apparent from this table, the Examples 1–3 are superior to the comparative examples in any of the evaluation items.

TABLE 1

| | Small-diameter filament | |
|---|---|---|
| | Diameter $d_3$ (mm) | Load at break (kgf) |
| S-1 | 0.12 | 3.3 |
| S-2 | 0.135 | 4.2 |
| S-3 | 0.15 | 5.1 |
| S-4 | 0.17 | 6.6 |
| S-5 | 0.20 | 8.5 |

TABLE 2

| | Medium-diameter filament | |
|---|---|---|
| | Diameter $d_2$ (mm) | Load at break (kgf) |
| M-1 | 0.22 | 10.3 |
| M-2 | 0.25 | 13.2 |
| M-3 | 0.27 | 15.3 |
| M-4 | 0.29 | 17.6 |

TABLE 3

| | Large-diameter filament | |
|---|---|---|
| | Diameter $d_1$ (mm) | Load at break (kgf) |
| L-1 | 0.32 | 21.3 |
| L-2 | 0.35 | 25.4 |
| L-3 | 0.38 | 28.9 |

TABLE 4

| | Steel cords $1 \times 3 \times (d_1,d_2,d_3)$ | Diameter ratio of filament $d_2/d_1,d_3/d_1$ | Load at break (kgf) | Diameter ratio of cord: Before cutting $D_{C1}/D_S$ | Diameter ratio of cord: After cutting $D_{C2}/D_S$ | Evaluation of $1 \times 3 \times (d_1,d_2,d_3)$ cord (Cut length L = 500 mm): Length A*1 (mm) | Length B*2 (mm): Medium-dia. filament | Length B*2 (mm): Small-dia. filament | Rubber penetration (%) | Total evaluation |
|---|---|---|---|---|---|---|---|---|---|---|
| EX. (1) | $1 \times 3 \times (0.32,0.22,0.12)$ | 0.69,0.38 | 31.4 | 1.00 | 1.52 | 45 | 11 | 26 | 100 | ○ |
| Comp. EX. (1) | $1 \times 3 \times (0.32,0.27,0.15)$ | 0.84,0.47 | 35.5 | 1.00 | 1.40 | 38 | 4 | 17 | 80 | Δ |
| Comp. EX. (2) | $1 \times 3 \times (0.32,0.29,0.175)$ | 0.91,0.55 | 41.0 | 1.09 | 1.34 | 22 | 3 | 14 | 70 | Δ |
| Comp. EX. (3) | $1 \times 3 \times (0.32,0.22,0.20)$ | 0.69,0.63 | 35.5 | 1.13 | 1.29 | 23 | 9 | 10 | 30 | x |
| EX. (2) | $1 \times 3 \times (0.35,0.25,0.135)$ | 0.71,0.39 | 38.5 | 1.00 | 1.54 | 46 | 10 | 28 | 90 | ○ |
| Comp. EX. (4) | $1 \times 3 \times (0.35,0.29,0.175)$ | 0.83,0.50 | 45.1 | 1.00 | 1.37 | 24 | 8 | 13 | 60 | x |
| Comp. EX. (5) | $1 \times 3 \times (0.35,0.29,0.20)$ | 0.83,0.57 | 47.4 | 1.04 | 1.33 | 18 | 5 | 16 | 40 | x |
| Comp. EX. (6) | $1 \times 3 \times (0.35,0.27,0.20)$ | 0.77,0.57 | 45.2 | 1.11 | 1.36 | 21 | 9 | 14 | 40 | x |
| EX. (3) | $1 \times 3 \times (0.38,0.27,0.15)$ | 0.71,0.39 | 45.1 | 1.00 | 1.55 | 43 | 12 | 24 | 90 | ○ |
| Comp. EX. (7) | $1 \times 3 \times (0.38,0.29,0.175)$ | 0.76,0.46 | 48.7 | 1.00 | 1.42 | 29 | 9 | 15 | 60 | Δ |
| Comp. EX. (8) | $1 \times 3 \times (0.38,0.29,0.20)$ | 0.76,0.53 | 50.6 | 1.05 | 1.35 | 19 | 7 | 13 | 50 | Δ |
| Comp. EX. (9) | $1 \times 3 \times (0.38,0.22,0.20)$ | 0.58,0.53 | 43.5 | 1.03 | 1.39 | 17 | 11 | 12 | 40 | x |

*1Length for which small-diameter filament has gotton loose away from the cord
*2Distance for which filaments have retracted from cord ends

What is claimed is:

1. A steel cord for reinforcing rubber comprising three brass-plated steel filaments each filament having a diameter different from the diameter of the other of the three filaments, the small-diameter and medium-diameter filaments of said three filaments having internal stresses when said small and medium diameter filaments are twisted together with a larger-diameter filament of said three filaments to form said rubber reinforcing cord for release of said internal stresses when said cord is cut at both ends thereof, so that, owing to said release of said internal stresses, when said both ends of said cord are cut, said medium-diameter filament at each of said both cut ends of said three filaments retract from said cut ends of said larger-diameter of said three cut filaments and said cut ends of said small-diameter filament retract from said cut ends of said larger and medium-diameter filaments, leaving at said cord cut ends only said large-diameter filament, the diameter of said cord before and after said cuts at both ends satisfying the following formulas:

$$Ds \leqq D_{c1} \leqq 1.15\ Ds, \text{ and}$$

$$1.35\ Ds \leqq D_{c2} \leqq 1.59\ Ds$$

wherein Ds is the diameter of the strand formed of said larger, medium and small diameter filaments;

$D_{c1}$ is the diameter of the cord uncut at both ends; and $D_{c2}$ is the diameter of the cord after being cut at both ends.

2. A steel cord for reinforcing rubber as claimed in claim 1, wherein each of said filaments of said three steel filaments has a diameters of from 0.10 to 0.40 mm, said small-diameter filament having a diameter from 0.31 to 0.50 time that of said larger-diameter filament, and said medium-diameter filament has a diameter 0.55 to 0.73 time that of said larger-diameter filament.

3. A composite structure comprising the steel cord as claimed in claim 1 or 2 and rubber, said steel cord being cut to a predetermined length and embedded in said rubber with said ends of said medium-diameter filament at the ends of said cut length retracted from said ends of said large-diameter filament and said ends of said small-diameter filament at said ends of said cut length retracted from said ends of said medium and small diameter filaments.

* * * * *